US006223948B1

(12) United States Patent
Davis

(10) Patent No.: US 6,223,948 B1
(45) Date of Patent: May 1, 2001

(54) ADDITIVE INJECTOR FOR A DISPENSING VALVE

(75) Inventor: Harlan Ray Davis, San Antonio, TX (US)

(73) Assignee: Lancer Partnership, LTD, San Antonio, TX (US)

( * ) Notice: Subject to any disclaimer, the term of this patent is extended or adjusted under 35 U.S.C. 154(b) by 0 days.

(21) Appl. No.: 09/366,293

(22) Filed: Jul. 2, 1999

(51) Int. Cl.[7] ..... B67D 5/60
(52) U.S. Cl. ..... 222/132; 222/129.1
(58) Field of Search ..... 222/129.1, 129.2, 222/129.3, 129.4, 146.6, 148, 132; 239/433, 407, 310

(56) References Cited

U.S. PATENT DOCUMENTS

| | | | |
|---|---|---|---|
| 4,753,370 | 6/1988 | Rudick | 222/105 |
| 5,725,125 | 3/1998 | Bessette et al. | 222/1 |

*Primary Examiner*—Kevin Shaver
*Assistant Examiner*—Meg Cartagena
(74) *Attorney, Agent, or Firm*—Christopher L. Makay

(57) ABSTRACT

A beverage dispenser system includes a dispensing valve and an additive injector assembly linked with the dispensing valve. The additive injector assembly includes an injector unit for introducing additive flavoring to beverage fluid passing through the additive injector assembly from the dispensing valve. Moreover, a nozzle assembly linked with the additive injector assembly is provided by the beverage dispenser system for receiving beverage fluid and additive flavoring from the additive injector assembly. A base beverage with additive flavoring is thus dispensed from the beverage dispenser system via the nozzle assembly.

12 Claims, 4 Drawing Sheets

ADDITIVE INJECTOR FOR A DISPENSING VALVE

BACKGROUND OF THE INVENTION

1. Field of the Invention

The present invention generally relates to dispensing equipment and, more particularly, but not by way of limitation, to an additive injector assembly for introducing additive flavoring to a base beverage dispensed from a beverage dispenser.

2. Description of the Related Art

Beverage dispensers provide a wide variety of beverages by combining beverage fluids. Typically, concentrate is combined with diluent to form a beverage of choice or "base beverage". For example, juice, coffee, and punch concentrate is combined with water as the diluent so that a beverage dispenser may provide juice, coffee, and punch therefrom, respectively. Similarly, cola flavored beverage flavored syrup is combined with carbonated water as the diluent to obtain a cola flavored carbonated beverage.

Specifically, concentrate and diluent beverage fluids are each drawn from a respective beverage fluid source by a pump. Each beverage fluid is carried by a separate beverage fluid line from the beverage fluid source to a dispensing valve assembly. Beverage fluids are then combined as they pass through a nozzle assembly provided by the dispensing valve assembly to form the base beverage.

Increasing consumer demands for convenience, personalized service, and expediency now require that beverage dispensers provide additive flavoring or "condiments" for the base drink dispensed, such as cream for coffee as well as cherry, vanilla or chocolate flavoring to be added to cola to create an old fashioned, soda fountain-style beverage. Unfortunately, as evidenced in prior art, past attempts to satisfy these consumer demands has imposed unreasonable economic burdens on the industry in terms of manufacturing and maintaining such condiment dispensing beverage dispensers.

In particular, U.S. Pat. No. 2,880,912, which issued to Fisher and is entitled "System for Dispensing Flavored Beverages", and U.S. Pat. No. 5,960,997, which issued to Forsythe and is entitled "Beverage Dispensing Apparatus", each provide a highly specialized beverage dispenser for dispensing condiments. Costs are higher for manufacturing this specialty item apart from standard beverage dispensers. Moreover, standard beverage dispenser owners must undergo added expenses of purchasing another beverage dispenser only for the option of providing condiments for a base beverage.

Furthermore, current beverage dispensers that dispense condiments unfavorably feature exposed parts, such as the Forsythe application as well as U.S. Pat. No. 2,949,933, which issued to Adler and is entitled "Dispensing Machines". If not properly maintained, dirt, grime, and potentially hazardous microorganisms can accumulate on these exposed parts, thereby compromising the health of consumers.

Accordingly, there is a long felt need for a low cost, low maintenance additive injector that integrates with existing beverage dispensers for delivering condiments thereto.

SUMMARY OF THE INVENTION

In accordance with the present invention, a beverage dispenser system includes a dispensing valve and an additive injector assembly linked with the dispensing valve. The additive injector assembly includes an injector unit for introducing additive flavoring, drawn from an additive flavoring source, to beverage fluid passing through the additive injector assembly from the dispensing valve. Moreover, a nozzle assembly linked with the additive injector assembly is provided by the beverage dispenser system for receiving beverage fluid and additive flavoring from the additive injector assembly. A base beverage with additive flavoring is thus dispensed from the beverage dispenser system via the nozzle assembly.

As such, the preferred additive injector assembly is configured to be incorporated with a well known beverage dispenser. The additive injector assembly is self-cleaning in that any residual additive flavoring is washed out of the injector unit by beverage fluid passing therethrough.

The injector unit of the additive injector assembly includes a mixing chamber, whereby additive flavoring is combined with beverage fluid passing through the additive injector assembly without exposure to the surrounding external environment. The injector unit includes an injector body whereby the injector body may form the mixing chamber. Inasmuch, the dispensing valve is secured to the injector body. The injector body, in turn, is secured to the nozzle assembly.

The injector body includes a condiment inlet for receiving additive flavoring from an additive flavoring source. The additive injector assembly may include a condiment line linked with the additive flavoring source and with the injector body for delivering additive flavoring to the injector unit. Moreover, a fitting secured to and in communication with the condiment inlet may be provided for coupling the condiment line with the injector body.

A condiment inlet passageway extending from the condiment inlet through the injector body to the mixing chamber is provided by the injector body to deliver additive flavoring from the additive flavoring source to the mixing chamber. The injector body may include a plurality of condiment inlets and corresponding inlet passageways.

In the preferred embodiment, a beverage dispenser system includes a dispensing valve for discharging a first stream and a second stream of beverage fluid therefrom. An additive injector assembly linked with the dispensing valve is provided for introducing additive flavoring to the first stream of beverage fluid passing through the additive injector assembly from the dispensing valve. The beverage dispenser system includes a nozzle assembly linked with the additive injector assembly for receiving the second stream and the first stream of additive flavoring from the additive injector assembly. Arising from the combination of the second stream and the first stream with additive flavoring, an additive flavoring enhanced base beverage is thus dispensed from the beverage dispenser system via the nozzle assembly. Additionally, the beverage dispenser system may include a bypass linker linked with the dispensing valve and with the nozzle assembly for directing the second stream of beverage fluid from the dispensing valve to the nozzle assembly.

In accordance with the present invention, a method for introducing additive flavoring to beverage fluid includes linking an additive injector assembly with a beverage dispenser system. Beverage fluid for forming a base beverage is passed through the beverage dispenser system. Additive flavoring is introduced to the beverage fluid passing through the additive injector via the injector unit described above. As such, additive flavoring is combined with the beverage fluid in the mixing chamber.

It is therefore an object of the present invention to provide a beverage dispenser system and an associated method for introducing additive flavoring to beverage fluid.

It is a further object of the present invention to provide a low cost, low maintenance additive injector assembly that integrates with existing beverage dispensers for delivering additive flavoring thereto.

Still other objects, features, and advantages of the present invention will become evident to those skilled in the art in light of the following.

BRIEF DESCRIPTION OF THE DRAWINGS

FIG. 3 illustrates an injector unit from the additive injector assembly according to the preferred embodiment for combining additive flavoring with a base beverage.

FIG. 4 illustrates an injector unit.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms; the figures are not necessarily to scale; and some features may be exaggerated to show details of particular components or steps.

Figure 1:
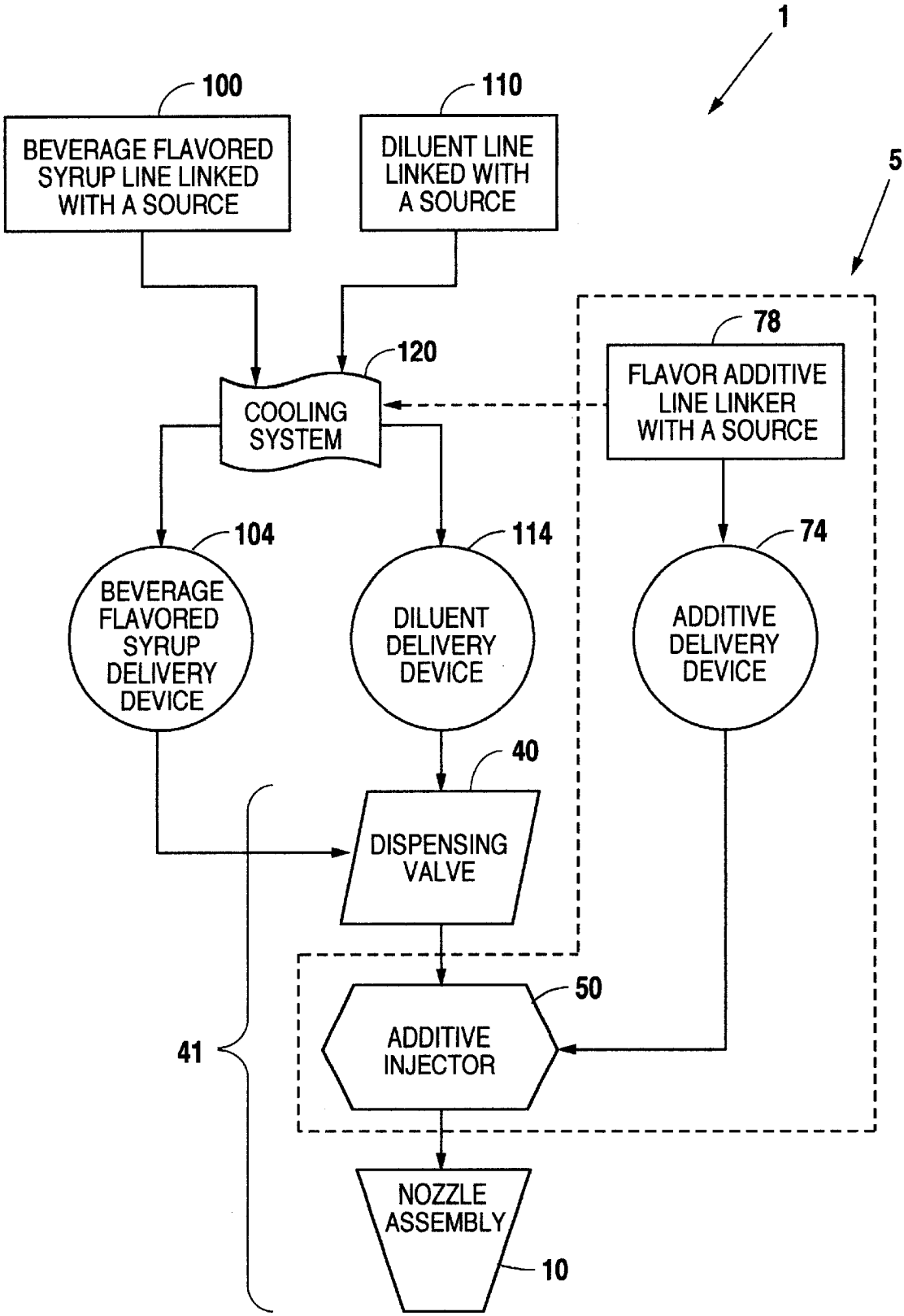
FIG. 1 is a schematic illustrating a beverage dispenser system according to the preferred embodiment that dispenses a base beverage therefrom, the beverage dispenser system features an additive injector assembly for introducing additive flavoring to the base beverage.

In FIG. 1, an additive injector assembly 5 is incorporated with a beverage dispenser system 1. In the preferred embodiment, the beverage dispenser system 1 comprises a standard beverage dispenser of a type well known in the industry.

The beverage dispenser system 1 provides a broad range of popular beverages by combining beverage fluids supplied thereto. Specifically, concentrate or "beverage flavored syrup" is combined with diluent to form a beverage of choice or "base beverage", such as cola, coffee or punch.

As shown in FIG. 1, beverage flavored syrup and diluent beverage fluids are each drawn from a respective beverage fluid source (not shown) by a beverage flavored syrup delivery device 104 and a diluent delivery device 114, respectively. In the preferred embodiment, although those of ordinary skill in the art will recognize other suitable means for drawing beverage fluids, the beverage flavored syrup delivery device 104 and the diluent delivery device 114 each comprise a standard pump widely known in the industry.

Beverage flavored syrup and diluent are carried by a beverage flavored syrup line 100 and a diluent line 110, respectively, from their sources to a dispensing valve assembly 41. Beverage flavored syrup and diluent are then combined as they pass through the dispensing valve assembly 41 to form the base beverage. Moreover, as in this preferred embodiment, a cooling system, linked with the beverage flavored syrup line 100 and with the diluent line 110, may be provided for cooling beverage fluids prior to entering the dispensing valve assembly 41 to enhance the drink formation process.

The dispensing valve assembly 41 includes a dispensing valve 40 for receiving beverage fluids from the beverage flavored syrup line 100 and the diluent line 110. In this preferred embodiment the dispensing valve 40 comprises a standard dispensing valve well known in the industry. It should be added, however, that other embodiments contemplate the dispensing valve 40 as comprising a volumetric dispensing valve such as that described in U.S. Pat. No. 5,381,926, entitled "Beverage Dispensing Valve and Method" and assigned to the Coca-Cola Company.

The dispensing valve assembly 41 includes a nozzle assembly 10 in operative engagement with the dispensing valve 40 for receiving and combining beverage flavored syrup and diluent to form the base beverage. The preferred nozzle assembly 10 comprises a standard nozzle assembly well known in industry.

Figure 2:
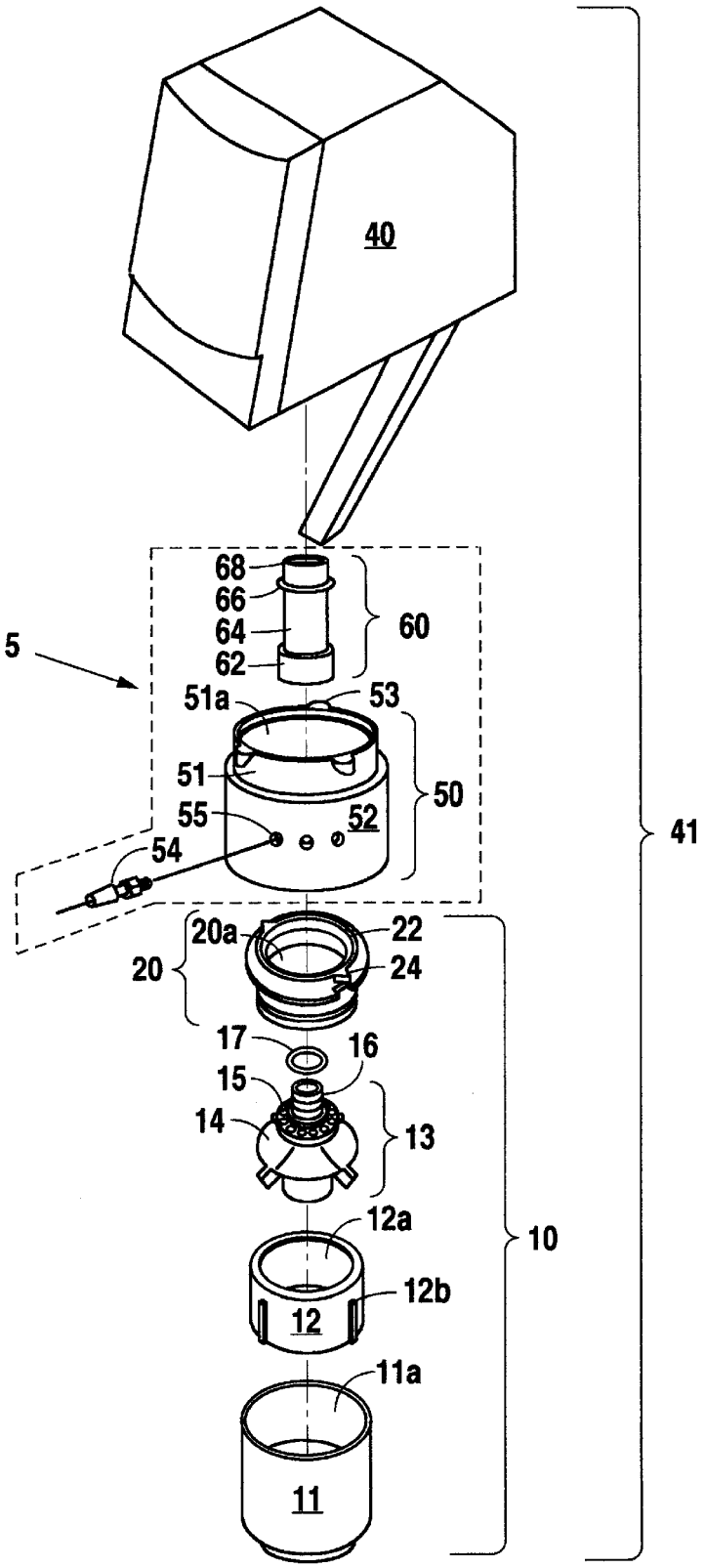
FIG. 2 is an exploded view illustrating a dispensing valve assembly whereby an additive injector assembly is integrated with a dispensing valve and a nozzle assembly.

Illustratively, as shown in FIG. 2, the nozzle assembly 10 includes a nozzle housing 11 and a nozzle connector cap 20 secured thereto. The nozzle assembly 10 further includes a diffuser 13 disposed within the nozzle housing 11 for engagement with beverage fluids flowing therethrough. A spacer 12 disposed within the nozzle housing 11 is also provided, whereby the diffuser 13 rests thereon.

The nozzle connector cap 20 includes a cap lip 22 extending outwardly from the nozzle connector cap 20 for insertion into the dispensing valve 40. The cap lip 22 may include nozzle locking tabs 24 for securing the connector cap 20 to the dispensing valve 40. The nozzle connector cap 20 further includes a fluid separation passageway 20*a* passing through the nozzle connector cap 20 for receiving a first stream of beverage fluid from the dispensing valve 40.

The diffuser 13 includes a diffuser neck 16 extending outwardly from the diffuser 13 for receiving a second stream of beverage fluid from the dispensing valve 40. Inasmuch, the diffuser neck 16 is inserted into the dispensing valve 40, whereby the second stream of beverage fluid flows from the dispensing valve 40 through the diffuser neck 16 and the diffuser 13 to the spacer 12. Additionally, a connection seal 17 is provided about the diffuser neck 16 for sealing the coupling between the diffuser neck 16 and the dispensing valve 40.

To accommodate the first stream of beverage fluid, the diffuser 13 includes a diffuser plate 15 secured to the base of the diffuser neck 16 whereby the first stream of beverage fluid flows from the dispensing valve 40, across the fluid separation passageway 20*a*, about the exterior of the diffuser neck 16, and through the diffuser plate 15. A deflection skirt 14 is also provided for receiving the first stream of beverage fluid flowing from the diffuser plate 15 and for channeling the first stream about the spacer 12.

The spacer 12 thus includes an inner wall 12*a* of the spacer 12 and an outer wall 12*b*. Accordingly, the first stream of beverage fluid flows from the diffuser skirt 14 across a first stream passageway formed between the outer wall 12*b* and a nozzle housing inner surface 11*a* and out the dispensing valve assembly 41. In a similar manner, the second stream of beverage fluid flows from the diff-user 13 through the inner wall 12*a* and out the dispensing valve assembly 41. On exiting the first stream passageway as well as the inner wall 12*a*, the first and second streams of beverage fluid, respectively, combine to form the desired base beverage.

Illustratively, if cola is desired, the dispensing valve 40 is activated by an operator, thereby allowing the first stream of beverage fluid, carbonated water, and the second stream of beverage fluid, cola flavoring, to flow from the dispensing valve 40 to the dispensing valve assembly 41. Carbonated water thus flows from the dispensing valve 40 through the fluid separation passageway 20*a*, the diff-user plate 15, the deflection skirt 14, the first stream passageway, and out the dispensing valve assembly 41. Similarly, cola flavoring flows from the dispensing valve 40 through the diffuser neck 16, the inner wall 12*a*, and out the dispensing valve assembly 41. Therefore, on exiting the first stream passageway as well as the inner wall 12*a*, the cola flavoring and carbonated water, respectively, combine to form cola as the desired base beverage.

As shown in FIGS. 1 and 2, the dispensing valve assembly 41 includes the additive injector assembly 5. The additive injector assembly 5, in turn, includes an injector unit 50 and a bypass linker 60 disposed within the injector unit 50, each interposed with the dispensing valve 40 and the nozzle assembly 10. In particular, the bypass linker 60 is linked at one end with the diffuser neck 16, extends through the injector unit 50, and inserts within the dispensing valve 40, thereby facilitating uninterrupted flow of the second stream of beverage fluid from the dispensing valve 40 to the diffuser neck 16.

In this preferred embodiment, the additive injector assembly 5 is provided for introducing condiments to the base beverage by combining additive flavoring with the first stream of beverage fluid passing through the injector unit 50. Inasmuch, by introducing additive flavoring while the base beverage is forming, the injector unit 50 is self-cleaning in that any residual additive flavoring is washed out of the injector unit 50 by the first stream of beverage fluid, thereby preventing deposit build-up as with beverage dispensers in the past. The introduction of additive flavoring to the first stream of beverage fluid is implemented entirely within the injector unit 50 so that beverage fluids are not exposed to the surrounding external environment.

This self-cleaning effect largely eliminates the costly need for routine cleaning and maintenance. Moreover, by introducing additive flavoring therein via the self-cleaning effect, the injector unit 50 promotes consumer health by inhibiting the accumulation of dirt, grime, and potentially hazardous microorganisms on exposed parts. It should also be added that the injector unit 50 and bypass linker 60 are each configured to fit between a standard dispensing valve and nozzle, thereby eliminating the need for obtaining an entire beverage dispenser that features an option for dispensing condiments therefrom.

Figure 3A:
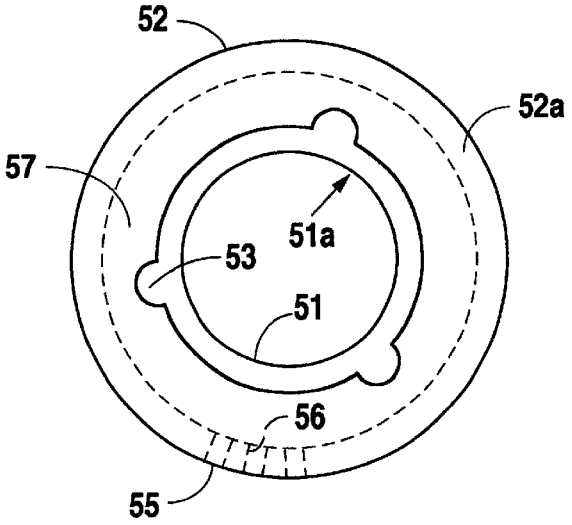
FIG. 3*a* is a top view of the injector unit.
Figure 3B:
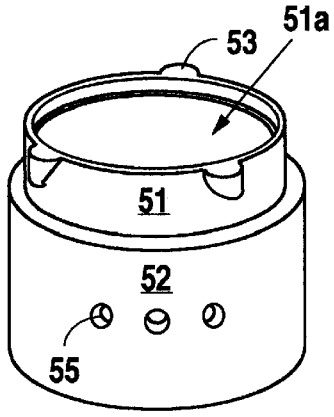
FIG. 3*b* is a perspective view along the side of the injector unit.
Figure 3C:
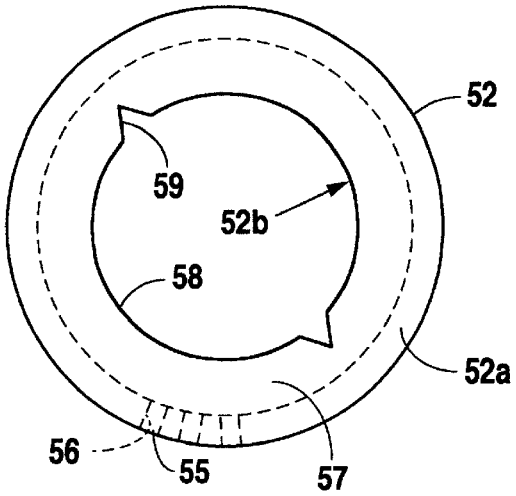
FIG. 3*c* is a bottom view of the injector unit.
Figure 4C:
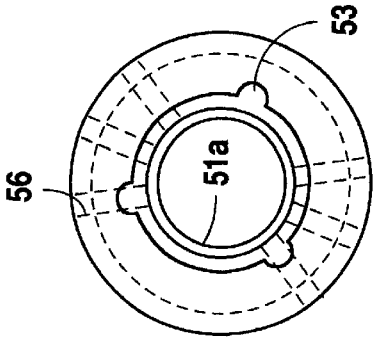
FIG. 4*c* is a top view of the injector unit.
Figure 4B:
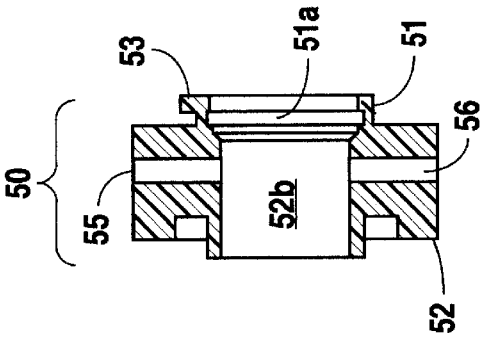
FIG. 4*b* is a cross-sectional view along the side of the injector unit.
Figure 4A:
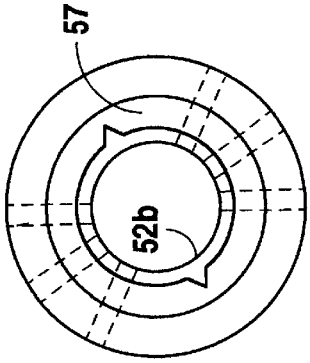
FIG. 4*a* is a bottom view of the injector unit.

In particular, as shown in FIGS. 3–4, the injector unit 50 includes an injector body 52 wherein condiments are introduced to the base beverage. As such, the injector body 52 features a mixing chamber 57 wherein additive flavoring is combined with the first stream of beverage fluid passing therethrough. In the preferred embodiment, the mixing chamber 57 is formed by a body wall 52*a* of the injector body 52. It is critical that this combination be implemented entirely within the mixing chamber 57 to prevent unhealthy and unsanitary exposure to the surrounding external environment.

The injector unit 50 includes at least one condiment inlet 55 for receiving additive flavoring. A corresponding condiment inlet passageway 56, extending from the condiment inlet 55 through the body wall 52*a*, channels additive flavoring from the condiment inlet passageway 56 to the mixing chamber 57 for combination with the first stream of beverage fluid. Although a various additive flavorings may be introduced via a single condiment inlet and a corresponding inlet passageway, this preferred embodiment contemplates a plurality of condiment inlets and corresponding inlet passageways, as shown in FIGS. 3–4. Accordingly, a single additive flavoring is introduced through each condiment inlet and corresponding inlet passageway. For example, a separate condiment inlet for cherry, vanilla, and chocolate flavorings is contemplated for combination with a cola base beverage or a separate condiment inlet for cream and sweetener is contemplated for combination with a coffee base beverage.

As shown in FIG. 1, the preferred additive injector assembly 5 includes a condiment delivery device 74 for drawing additive flavoring from a respective additive flavoring source (not shown). In the preferred embodiment, although those of ordinary skill in the art will recognize other suitable means for drawing additive flavoring, the condiment delivery device 74 comprises a standard pump widely known in the industry.

Additive flavoring is thus carried by a condiment line 78 from the additive flavoring source to the dispensing valve assembly 41. As shown in FIG. 2, the additive injector assembly 5 includes a fitting 54, secured to and in communication with the condiment inlet 55 for coupling the condiment line 78 with the injector body 52. Accordingly, additive flavoring flows from the condiment line 78 through the fitting 54 to the condiment inlet 55 and, ultimately, to the mixing chamber 57.

Furthermore, as in the preferred embodiment, the injector unit 50 may include an injector lip 51 extending outwardly from the injector body 52 for insertion into the dispensing valve 40. As shown in FIGS. 3–4, the preferred injector lip 51 includes injector locking tabs 53 for securing the injector unit 50 to the dispensing valve 40. Similarly, as shown in FIG. 3, the injector unit 50 may include an injector groove 58 for facilitating the insertion of the nozzle assembly 10 into the injector unit 50. Moreover, the preferred injector groove 58 includes injector locking notches 59 formed by the injector groove 58 for receiving the nozzle locking tabs 24 therethrough. The nozzle locking tabs 24 are in slideable engagement with the injector groove 58 for securing the nozzle assembly 10 thereto. It should be added, however, that those of ordinary skill in the art will recognize other suitable means for linking the injector unit 50 with the dispensing valve 40 as well as with the nozzle assembly 10.

As shown in FIGS. 3–4, the preferred injector unit 50 includes a body passageway 52*b* passing through the injector body 52 and a lip passageway 51*a*, in communication with the body passageway 52*b*, passing through the injector lip 51. Thus, the first stream of beverage fluid flows from the dispensing valve 40 through the lip passageway 51*a* and the body passageway 52*b* to the nozzle assembly 10.

While passing through the body passageway 52*b*, the first stream of beverage fluid flows about the mixing chamber 57, thereby combining with the additive flavoring from the condiment inlet passageway 56 to form a modified first stream of beverage fluid. The modified first stream of beverage fluid then flows from the body passageway 52*b* to the nozzle assembly 10 to ultimately combine with the second stream of beverage fluid. Accordingly, insertion of an injector unit 50 between a dispensing valve 40 and a nozzle assembly 10 provides for the introduction of condiments to a base beverage.

To ensure that the modified first beverage fluid stream does not intermix with the second beverage fluid stream prior to entering the nozzle assembly 10, the preferred additive injector assembly 5 provides the bypass linker 60. As discussed above, the bypass linker 60 enables the additive injector assembly 5 to connect with any standard beverage dispenser system, thereby acting as an "extension passageway", coupling the diffuser neck 16 with the dispensing valve 40. It should be added, however, that other embodiments contemplate an additive injector assembly 5 without a bypass linker 60, whereby the first stream and the second stream of beverage fluid are combined with the additive flavoring in the mixing chamber 57.

Figure 5C:
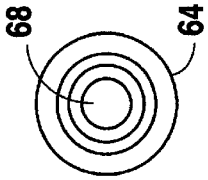
FIG. 5 illustrates a bypass link from the additive injector assembly according to the preferred embodiment for delivering beverage fluid from a dispensing valve to a nozzle assembly to form a base beverage with additive flavoring.
Figure 5B:
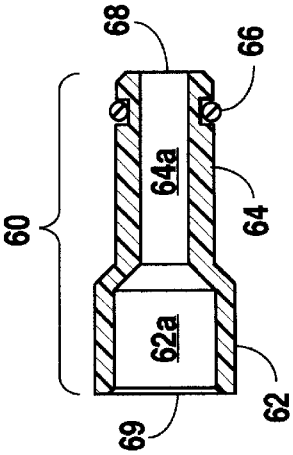
Figure 5A:
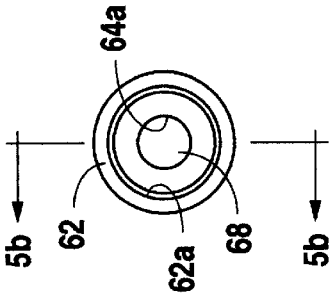

FIGS. 2 and 5 show the preferred bypass linker 60. In particular, the bypass linker 60 includes a bypass body 64 defming a bypass body passageway 64*a*, whereby the second stream of beverage fluid flows from the dispensing valve 40 through the bypass body passageway 64*a*. The bypass body 64 defines a beverage dispenser interface opening 68 configured for insertion into the dispensing valve 40 and for directing the second stream of beverage fluid into the body passageway 64*a*. A bypass connection seal 66 is also provided about the bypass body 64 for sealing the coupling between the bypass linker 60 and the dispensing valve 40.

In the preferred embodiment, the bypass linker 60 includes a bypass base 62 disposed on the bypass body 64. The bypass base 62 is provided to secure the bypass body 64 to the diffuser neck 16. The second stream of beverage fluid thus flows from the bypass body passageway 64*a* through a bypass base passageway 62*a* formed by the bypass base 62 and in communication with the bypass body passageway 64*a*. It should be added that the bypass base passageway 62*a* defines a diff-user neck interface opening 69 for engagement with the diffuser neck 16 and for directing the second stream of beverage fluid to the nozzle assembly 10. As such, the second stream flows from the bypass body passageway 64*a* through the bypass base passageway 62*a* to the diffuser neck 16.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

I claim:

1. A beverage dispenser system, comprising:

a dispensing valve that receives a beverage flavored syrup, and delivers the beverage flavored syrup to a first outlet therefrom and that receives a diluent and delivers the diluent to a second outlet therefrom;

an additive injector assembly linked with the dispensing valve, the additive injector assembly including a bypass linker coupled with the first outlet of the dispensing valve for receiving the beverage flavored syrup therethrough and an injector unit coupled with the second outlet of the dispensing valve for receiving diluent therethrough, whereby the injector unit introduces additive flavoring into the diluent passing therethrough; and a nozzle assembly linked with the bypass linker and the additive injector unit for receiving the beverage flavored syrup and the diluent mixed with the additive flavoring, whereby the nozzle assembly combines the beverage flavored syrup and the diluent mixed with the additive flavoring to produce a desired beverage dispensed therefrom.

2. The beverage dispenser system according to claim 1 wherein the bypass linker is disposed within the additive injector unit.

3. The beverage dispenser system according to claim 1 wherein the additive injector assembly is self-cleaning in that residual additive flavoring is washed out of the injector unit by diluent passing therethrough.

4. The beverage dispenser system according to claim 1 further comprising:

a condiment delivery device for drawing additive flavoring from an additive favoring source.

5. The beverage dispenser system according to claim 4 wherein the condiment delivery device comprises a pump.

6. The beverage dispenser system according to claim 1 wherein the injector unit includes a mixing chamber whereby additive flavoring is combined with the diluent passing through the additive injector assembly without exposure to the surrounding external environment.

7. The beverage dispenser system according to claim 6 wherein the injector unit further includes an injector body defining the mixing chamber.

8. The beverage dispenser system according to claim 7 wherein the injector body includes:

a condiment inlet for receiving additive flavoring from an additive flavoring source; and a condiment inlet passageway extending from the condiment inlet through the injector body to the mixing chamber, thereby delivering additive flavoring from the additive flavoring source to the mixing chamber.

9. The beverage dispenser system according to claim 8 wherein the additive injector assembly further includes a condiment line linked with the additive flavoring source and with the injector body for delivering additive flavoring to the injector unit.

10. The beverage dispenser system according to claim 9 wherein the additive injector assembly further includes a fitting secured to and in communication with the condiment inlet for coupling the condiment line with the injector body.

11. The beverage dispenser system according to claim 7 wherein the injector body includes:

a plurality of condiment inlets for receiving additive flavoring from respective additive flavoring sources; and a plurality of corresponding condiment inlet passageways extending from each respective condiment inlet through the injector body to the mixing chamber, thereby delivering additive flavoring from respective additive flavoring sources to the mixing chamber.

12. The beverage dispenser system according to claim 1 wherein the nozzle assembly, comprises:

a nozzle connector cap coupled to the injector unit;

a housing coupled to the nozzle connector cap, the housing defining a mixing chamber; and a diffuser disposed in the housing, the diffuser coupled to the bypass linker for receiving the beverage flavored syrup therethrough and delivering the beverage flavored syrup into the mixing chamber, whereby the additive injector unit delivers the diluent mixed with the additive flavoring around the diffuser and into the mixing chamber for combination with the beverage flavored syrup to produce a desired beverage dispensed from the nozzle assembly.

* * * * *